United States Patent [19]

Teichmann

[11] 4,398,838

[45] Aug. 16, 1983

[54] TYPEWRITER RIBBON LIFTING AND TRANSPORTING DEVICE

[75] Inventor: Friedrich Teichmann, Feucht, Fed. Rep. of Germany

[73] Assignee: Triumph-Adler A.G. fur Buro- und Informationstechnik, Nuremberg, Fed. Rep. of Germany

[21] Appl. No.: 289,328

[22] Filed: Aug. 3, 1981

[30] Foreign Application Priority Data

Sep. 26, 1980 [DE] Fed. Rep. of Germany ..... 3036337

[51] Int. Cl.[3] ..... B41J 35/10

[52] U.S. Cl. ..... 400/212; 400/215; 400/236.1

[58] Field of Search ..... 400/212, 211, 236.1, 400/215, 215.1, 215.2, 216, 216.5

[56] References Cited

U.S. PATENT DOCUMENTS

| | | | |
|---|---|---|---|
| 3,584,722 | 6/1971 | Albrile | 400/235.1 X |
| 3,891,078 | 6/1975 | Jung | 400/212 X |
| 4,239,400 | 12/1980 | Giolitti | 400/184 X |
| 4,329,072 | 5/1982 | Kacmarcik | 400/236.1 X |

FOREIGN PATENT DOCUMENTS

| | | | |
|---|---|---|---|
| 1911122 | 9/1970 | Fed. Rep. of Germany | 400/236.1 |
| 2045849 | 5/1972 | Fed. Rep. of Germany | 400/211 |
| 2929559 | 2/1980 | Fed. Rep. of Germany . | |

*Primary Examiner*—Edgar S. Burr
*Assistant Examiner*—Charles A. Pearson
*Attorney, Agent, or Firm*—Joseph R. Spalla

[57] ABSTRACT

The invention is a mechanism for raising and lowering the ribbon in typewriters to make typed text visible. No separate drive such as a motor or magnet is required to raise the ribbon. The ribbon is raised by means of a spring-loaded bar prior to each character reproduction. To accomplish this, an armature of a control magnet releases a pivoting lever and the spring loaded bar. A pin wheel, driven by a motor and acting on the lever serves to return the bar and allow return of the ribbon. The motor is energized after each character reproduction to advance either a type element carrier or the paper carrier by one character space. In typewriters with ribbon spools fixed to the machine frame, the ribbon spool drive also can be derived from the spring powered bar.

5 Claims, 2 Drawing Figures

TYPEWRITER RIBBON LIFTING AND TRANSPORTING DEVICE

Figure 1:
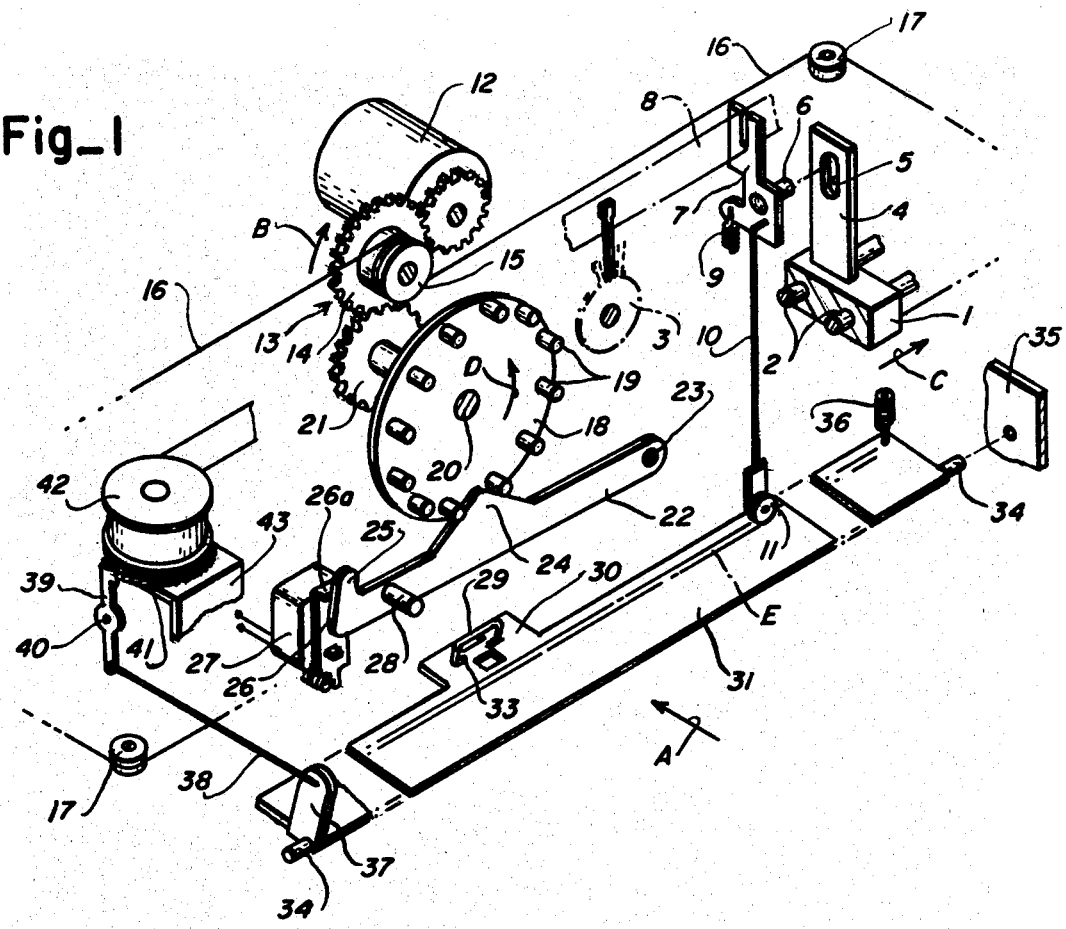

This invention relates to ribbon elevating and transport for a typewriter or similar machine.

In typewriters it is necessary to raise the ribbon before reproducing a character and to lower it after the reproduction. This makes it possible for the operator to see the last typed character. A number of devices have become known which effect the raising and lowering of the ribbon. In power-driven typewriters, lifting magnets are often used for the control of the ribbon e.g. DE-OS No. 29 29 559. Since these magnets do not act as control magnets, they must be relatively strong. If energized as long as the ribbon has to remain in the raised position, they develop considerable heat after only a relatively short operating period. To prevent this it is also known to coordinate with the magnet a transmission which keeps the ribbon in raised position. However, this means the use of additional components which make the machine more expensive. Moreover, these additional components are not so easy to assemble because close tolerances must be maintained also. Also known are typewriters in which an additional drive for the ribbon transport is derived from a motor or another magnet. This again means higher manufacturing costs.

The invention solves the problem of providing a reliable lifting mechanism for the ribbon which, however, does not require a separate dedicated power drive. In accordance with the invention, the ribbon is brought into the raised position by means of a spring and is lowerable again by means of the power drive of the machine such as a stepping motor, which is required to move either the paper carrier or the type element carrier according to whether the machine is a fixed or movable printing point machine. In accordance with the invention the mechanism can also be used in a typewriter having ribbon spools mounted stationarily but rotatably in the machine frame as in fixed printing point typewriters. In such machines, the line spacer pawl drive can be derived simultaneously from the bar which affects the ribbon transport in the usual manner by means of a toothed wheel.

An object of the invention is to provide ribbon elevating and transport mechanism characterized by few components, and in particular by a reduction of different power drives.

Figure 2:
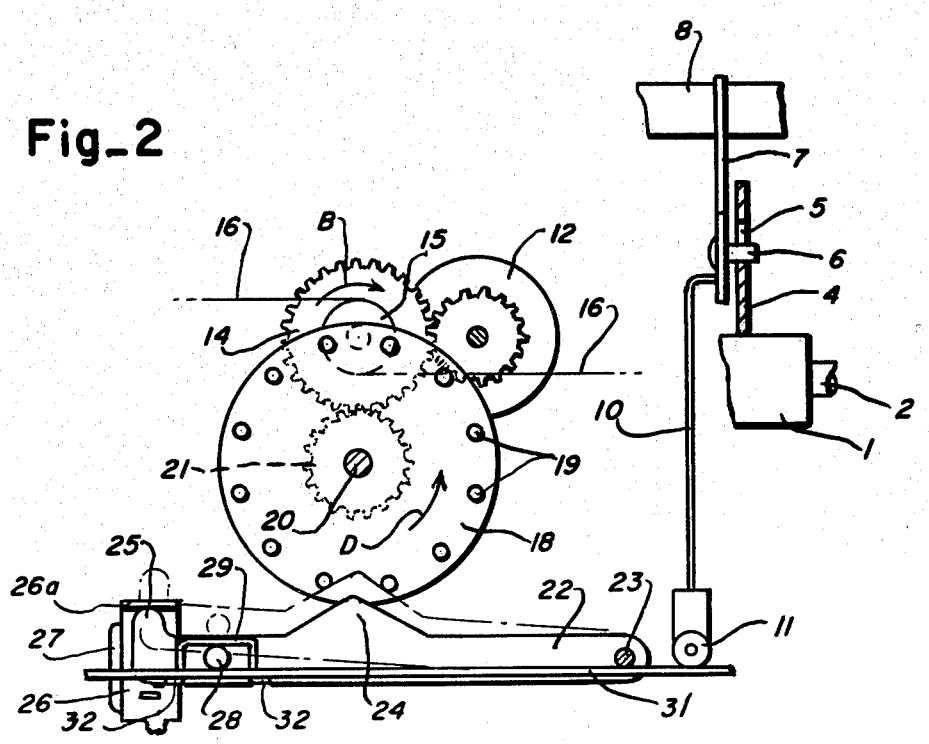

Other objects, features and advantages of the present invention will become known to those skilled in the art from a reading of the following detailed description when taken in conjunction with the accompanying drawing wherein like reference numerals designate like or corresponding parts throughout the several views thereof, and wherein:

FIG. 1 is a perspective view of ribbon elevating and transport mechanism in accordance with the invention in a movable printing point typewriter; and FIG. 2 is an elevational view taken in the direction of arrow A in FIG. 1.

The invention will first be described by way of a movable printing point typewriter having a carrier 1 mounted for movement on guide rods 2 along the typed line and supporting, e.g., a daisy type wheel 3, it being understood the invention may also be embodied in other than daisy wheel typewriters. A side part 4 of the carrier 1 is provided with a vertical slot 5 to accommodate and guide movement of a pin 6 of a ribbon guide 7. A ribbon 8 extends through the ribbon guide 7 and is raised or lowered by the latter in a manner to be described. The ribbon guide 7 is engaged by a spring 9 which tends to bias the ribbon guide 7 down. A linkage 10 is connected to the ribbon guide 7 and has at its free end a rotatable roller 11, a sliding shoe or something similar.

Upon every key actuation a motor 12 drives a transmission generally designated by reference numeral 13. A gear 14 of the transmission 13 has a pulley 15 on which a pull rope 16 can wind or unwind. The pull rope 16 is led around suitable guide rollers 17 fixed in the machine frame. Both ends of the pull rope 16 are fastened to opposite sides of the carrier 1. It is obvious therefrom that if the pulley 15 is turned by the motor 12 in the direction of arrow B, the carrier 1 is moved in the direction of arrow C. For this purpose, the motor 12 may be a stepping motor so that an additional stepping transmission is not needed.

A pin wheel 18 having a circular array of equi angularly spaced axially extending pins 19 is drivable by the transmission 13. The pin wheel 18 is mounted on a shaft 20 together with the gear 21 of the transmission 13. Disposed below the pin wheel 18 is a pivoting lever 22 which is pivotable about one end on a bearing pin 23. The pivoting lever 22 has in its central part an upwardly directed triangular hump 24 which interacts with the pins 19 in a manner to be described. The free end of the pivoting lever 22 is provided with a protrusion 25, in whose path of travel a bent out end **26*a* of an armature lever 26 of an electromagnet 27 is disposed. In addition, the pivoting lever 22 supports an axially extending bolt 28, which is kept in contact with a web 30 on a transverse bar 31 by means of a spring clip 29. The spring clip 29 has bent ends 32 (FIG. 2) which are pushed through slots 33 of the bar 31. This results in a particularly simple assembly of the connection between the transverse bar 31 and the bolt 28 of the pivoting lever 22. The transverse bar 31 is mounted by means of laterally extending pivot pins 34 in side parts 35 of the machine frame, for instance, and an extension spring 36 tends to urge the transverse bar 31 clockwise, as viewed in FIG. 1, about pivot pins 34**.

As may be seen from FIG. 2, in normal position, shown in full lines, the pivoting lever 22 is retained by the bent portion **26*a* of the armature lever 26, against the force of spring 36, in a position in which the hump 24 is outside the range of rotation of the pins 19 of the pin wheel 18. Upon each actuation of a character key, the selected character of the type wheel 3 is brought into printing position in known manner. Simultaneously, the magnet 27 is energized briefly so that it attracts the armature 26. This causes the bent portion 26*a* to slide off the protrusion 25 of the pivoting lever 22. This releases the force of spring 36 which swings the bar 31 clockwise upwardly about the pivot pins 34 and in turn pivoting lever 22 clockwise about its pivot to the dotted line position shown in FIG. 2 with the apex of the hump between two of the pins 19 on the pin wheel 18. Also, in turn, the transverse bar 31 acts against roller 11 of linkage 10 so that the ribbon guide 7 with the ribbon 8 is lifted to the level of the typed line against the force of the guide return spring 9. It is noted at this point that the force of spring 9 is considerably weaker than the force of spring 36**.

After the character has been reproduced, the carrier 1 must be advanced in the direction of arrow C by one character space. To accomplish this, the pulley 15 is turned in the direction of arrow B by an appropriate angular distance. This causes the right part of the pull rope 16, with reference to the drawing, to wind itself on the pulley 15, whereby the carrier 1 is advanced by one character space. At the same time, the pin wheel 18 turns in the direction of arrow D, thereby causing one of the pins 19 to engage the edge of triangular hump 24 and thereby push or cam the pivoting lever 22 down to the extent necessary to enable it to be again locked in its basic position by the bent portion 26*a* of the armature lever 26. This movement allows the spring 9 to downwardly restore the ribbon guide 7 guided by the slot 5 of the side part 4 of the carrier 1 so that the ribbon 8 does not obstruct the view of the typed line. Consequently, linkage 10 with the roller 11 follows every pivoting motion of the bar 31 up or down. Upon a stepwise motion of the carrier 1 the roller 11 rolls on the track E along the bar 31.

It is to be understood that the ribbon guide 7 may be designed, for instance, in the manner of a ribbon fork and mounted in the machine to a fixed frame part so as to be movable up and down. Such an arrangement is usually found in machines having a movable paper carrier. It is possible in such machines, therefore, to provide on the bar 31 a bent portion 37 which likewise follows each pivoting motion. By means of a pull wire 38 the bent portion 37 is connected to a pawl 39 which is pivotable about a pin 40. The pawl acts upon a toothed wheel 41 fixed to the ribbon spool 42 so as to corotate with it. This entire subassembly is mounted to a part 43 of the machine frame. The pivoting motion of the bar 31 is consequently transmitted to the pawl 39 which on its return stroke rotates the toothed wheel 41 by a certain angular distance so that the ribbon 8 is wound on the spool. This effects at the same time the transport of the ribbon 8, in addition to its being raised, so that an additional drive to accomplish this is unnecessary.

As will be appreciated from the above, the lifting of the ribbon 8 to the typed line prior to each reproduction, the lowering after each reproduction, and the transport of the ribbon occur upon each actuation of a character key with the stepping motor 12 and pin wheel 18, which perform a predetermined rotation after each character reproduction, assuring that the lowering of the ribbon 8 is reliably accomplished.

In a machine with movable paper carrier it will be understood that the roller 11 on the linkage 10 can be omitted because no relative motion takes place between the linkage and bar 31. Accordingly, the linkage 10 may be directly secured to the bar 31.

The invention claimed is:

1. In a typewriter having a carriage mounted for movement in escapement and carriage return directions, a carriage drive, and means coupled to said motor for driving said carriage in escapement direction upon energization of said motor incident to each character print action, ribbon guide means movable from a lowered position to an elevated position and from its elevated position to said lowered position incident to each character print action, spring powered means coupled to said ribbon guide means operable when released from a latched position to move said ribbon guide means from its lowered position to its elevated position, latching means releasably holding said spring powered means in a latched position, an electromagnet momentarily energizable incident to each print action for releasing said latch means, and restoring means coupled to said motor for restoring said released spring powered means to latched position upon energization of said motor incident to a print action.

2. In a typewriter as recited in claim 1, said restoring means comprising a wheel having a circular array of equi angularly spaced axially extending pins, said spring powered means including a lever pivoted at one end with its free end engaged by said latch means and releaseable therefrom upon energization of said electromagnet, said lever having a cam surface which upon release of said lever by said latch means is movable within the circle of rotation of said pins and is cammed thereby to restore the free end of said lever to latched condition, a pivotably mounted transverse bar connected to and adjacent to the free end of said lever, means coupling said transverse bar and said ribbon guide means, and a spring connected to said transverse bar for storing energy during restoration of said lever to latched condition for powering said released bar to drive said coupled ribbon guide means to elevated position.

3. A typewriter as recited in claim 2, means supporting said ribbon guide means on said carriage for movement between lowered and raised positions, and a roller on said ribbon guide means, said coupling means comprising a spring biasing said ribbon guide means to its lowered position to maintain said roller coupled to said transverse bar.

4. A typewriter as recited in claim 2, further comprising ribbon transport means operable incident to each movement of said pivotably mounted bar.

5. A typewriter as recited in claim 4, said transport means including a pivoted pawl and ribbon spool drive ratchet, and linkage connecting said bar and pawl.

* * * * *